United States Patent [19]

Strong

[11] Patent Number: 5,005,601

[45] Date of Patent: Apr. 9, 1991

[54] AUTOMATIC PROPORTIONING FERTILIZER INJECTOR

[76] Inventor: Thomas F. Strong, 8733 Magnolia, Ste. 100, Santee, Calif. 92071

[21] Appl. No.: 431,452

[22] Filed: Nov. 3, 1989

[51] Int. Cl.[5] ..... B01F 3/08

[52] U.S. Cl. ..... 137/205.5; 137/209

[58] Field of Search ..... 137/205.5, 268, 209; 239/310

[56] References Cited

U.S. PATENT DOCUMENTS

| | | | |
|---|---|---|---|
| 2,058,309 | 10/1936 | Haering | 137/205.5 |
| 2,064,627 | 12/1936 | Paine | 137/205.5 |
| 2,227,646 | 1/1941 | Hillmann | 137/205.5 X |
| 2,362,607 | 11/1944 | Albertson | 137/205.5 X |
| 2,642,886 | 1/1953 | Bell | 137/205.5 |
| 4,112,964 | 9/1978 | Banks | 137/205.5 |

*Primary Examiner*—Alan Cohan
*Attorney, Agent, or Firm*—Frank D. Gilliam

[57] ABSTRACT

At least one air tank and a tank of a solution to be injected into an irrigation system. Irrigation water is allowed to slowly fill the air tank. As the water rises in the air tank trapped air in the tank is compressed. This compressed air is allowed to pass into the top of the container of solution forcing the solution from the bottom of the container into the irrigation system. An adjustable metering valve controls the amount of solution that passes into the irrigation water and hence the amount of water that can flow into the air tank. The tank capacities are such that when the air tank is filled with water the solution has been exhausted from the solution tank. Drain means is provided in the air tank to drain the water therefrom.

9 Claims, 2 Drawing Sheets

AUTOMATIC PROPORTIONING FERTILIZER INJECTOR

BACKGROUND OF THE INVENTION

The invention relates generally to the injecting of liquid into a moving supply of water through a conduit and more particularly to the controlled injecting of liquid fertilizer into an irrigation system.

It will be understood that this invention is not limited to use with fertilizers injected into irrigation systems, but may be employed for the controlled injection of any liquid into another liquid flowing under pressure.

Prior art devices for the similar purposes can be found in U.S. Pat. Nos. 1,917,704; 2,120,608; 2,227,646; 2,510,373; 3,690,340; 3,776,274 and 3,807,434.

U.S. Pat. No. 1,917,704 teaches adding liquid under pressure from the supply line to the solution tank forcing the liquid from the solution tank into the supply line. A differential pressure is established to cause the liquids to flow into and out of the solution tank.

U.S. Pat. No. 2,120,608 teaches a liquid piston in a tank to apply a downward force on a solution in the bottom of the tank to inject that solution into the supply line by applying line pressure to the top of the piston which applies a downward force on the liquid piston and solution.

U.S. Pat. No. 2,227,646 teaches dispensing fertilizer into an irrigation system by providing a venturi at the point in the supply water pipe where fertilizer is to be introduced from a supply tank and by connecting a pressure head tank between the water pipe behind the venturi and the surface of the liquid fertilizer and locating a needle valve between the water stream and the fertilizer supply pipe. The pressure head is used to balance the pressure in a varying pressure in the supply water pipe and to prevent supply water backup into the fertilizer supply tank. The venturi draws the liquid fertilizer from the fertilizer supply tank.

U.S. Pat. No. 2,510,373 teaches generally injectors and particularly to metering injectors. Deferential pressure in the system due to siphonic action is used to dispense the liquid fertilizer.

U.S. Pat. No. 3,690,340 teaches flow resistors to vary the pressures in a dispensing system for the proportioning of two or more fluids.

U.S. Pat. No. 3,776,274 teaches suction for drawing a liquid chemical from a container for mixing with a liquid flowing through a pipe.

U.S. Pat. No. 3,807,434 teaches using a venturi to create a differential pressure between a container of chemical and a fluid flow stream to dispense chemical into the stream.

U.S. Pat. No. 4,391,390 teaches the use of fluid flow to create compressed air for dispensing a concentrated solution into the flow line. There is no teaching of any means for infinite variable metering of the concentrate into the fluid flow line, preventing the flow of liquid from the tank generating the pressurized air into the tank of concentrate when the pressure generating tank is filled with the flow liquid or means for automatically draining flow liquid from the container creating the pressurized air when the liquid flow is terminated.

U.S. Pat. No. 4,391,390 teaches a devise for dispensing two or more different chemicals, one of which is under pressure, into a fluid flow line. This system teaches a non-constant mixed fluid flow.

The present invention represents a significant improvement over the prior art by providing an improved liquid fertilizer dispensing device for use in commercial gardening or other purposes.

SUMMARY OF THE INVENTION

The invention is directed to two different preferred embodiments. In one embodiment a single container is connected to and communicates with a water line under pressure. As the water from the water line fills the container compressed air is developed within the container. This compressed air is fed into the top of a second container filled with a liquid fertilizer or the like. An outlet line from the bottom of the first container is connected to the water line downstream of the first container. The compressed air forces the liquid fertilizer or the like from the second container into the water line. The connection between the first and second containers contains a float valve which allows the free passage of air therethrough, but if the first container should fill with water the float within the ball valve seals off the communication between the two containers preventing water from entering the second container. A throttling valve is placed in series with the outlet line from the bottom of the second container and the water line. This valve allows an infinite variable control means for allowing the exact desired fertilizer or the like from the second container into the water line. In series with the water line upstream of the outline connection to the water line is positioned a relief valve that releases at around two pounds. The relief valve has a calibrated leak that allows liquid to be released therethrough below the two pound opening pressure. This feature along with a vent valve allows the first container now containing water to drain downstream and hence be ready for the next operation. A ball valve in the air tank prevents water from entering the liquid fertilizer tank when the air tank becomes filled with water. Drain plugs are located on the bottom of the container for cleaning etc. A pressure gauge on the top of the first container may be utilized for monitoring the pressure build up in the container and a sight gauge can be employed on the fertilizer tank to monitor the available fertilizer therein.

In a second embodiment the operation is as described above, but a second first container is employed in series with a first container for increasing the volume of available air pressure available to the system.

In the first embodiment the tanks are positioned in an upright position and in the second embodiment the tanks are positioned on their sides.

An object of this invention is to provide a finite variable liquid fertilizer dispensing system adjustable over an infinite range of liquid fertilizer blend concentrations.

Another object of this invention is to provide a liquid fertilizer dispensing system which when adjusted for a given dispensing concentration remains the same concentration until the irrigation water flow is changed or the system is adjusted for a different concentration.

Still another object of the invention is to provide a self draining of the irrigation water filled compressed air tank after the system is turned off.

These together with other objects and advantages which will become substantially apparent reside in the details of construction and operation as more fully hereinafter described and claimed, reference being made to the accompanying drawings forming a part hereof, wherein like numerals refer to like parts throughout.

DESCRIPTION OF THE FIRST PREFERRED EMBODIMENT

Figure 1:
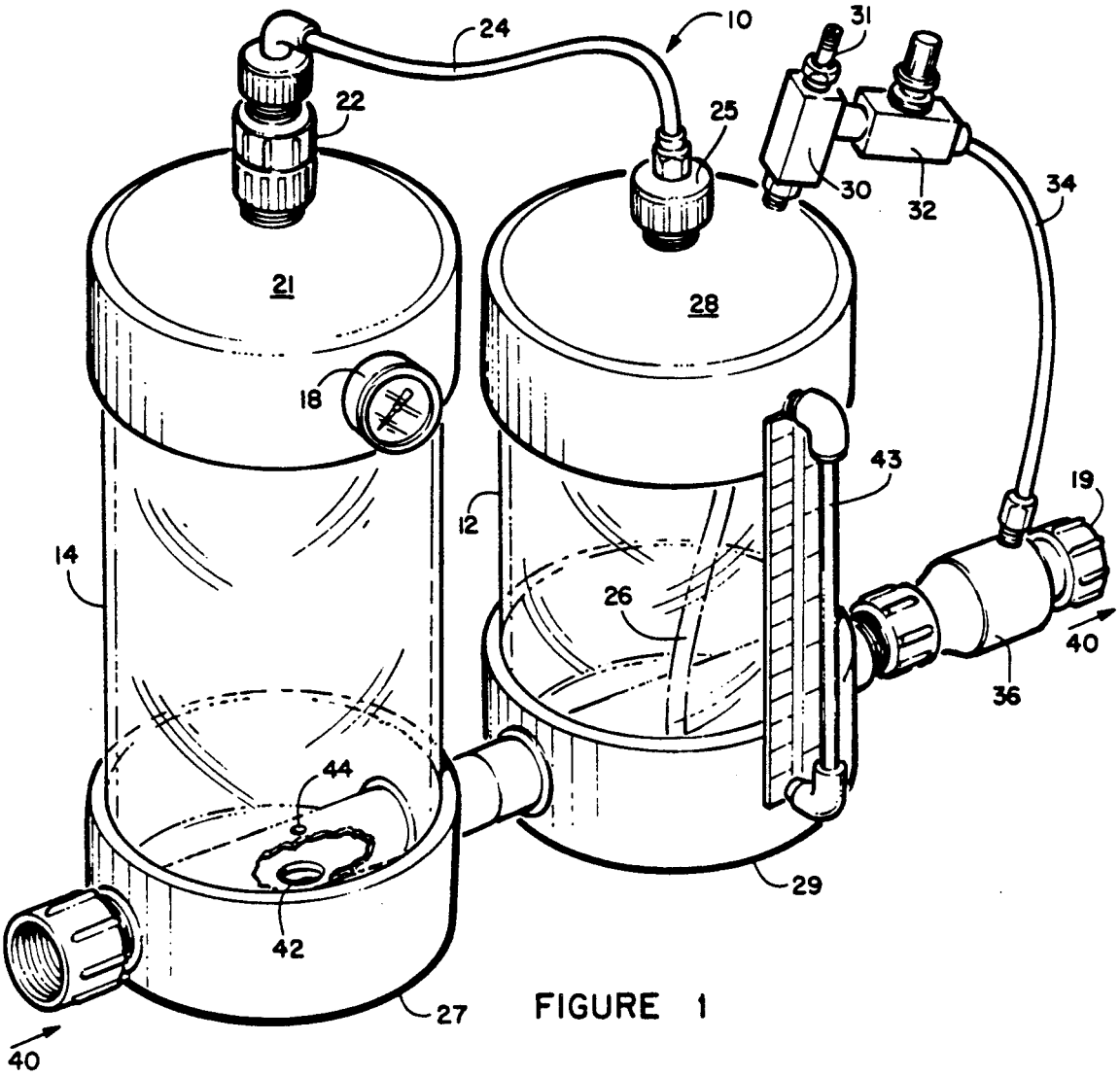
FIG. 1 is a perspective showing of a first embodiment of the invention.
Figure 2:
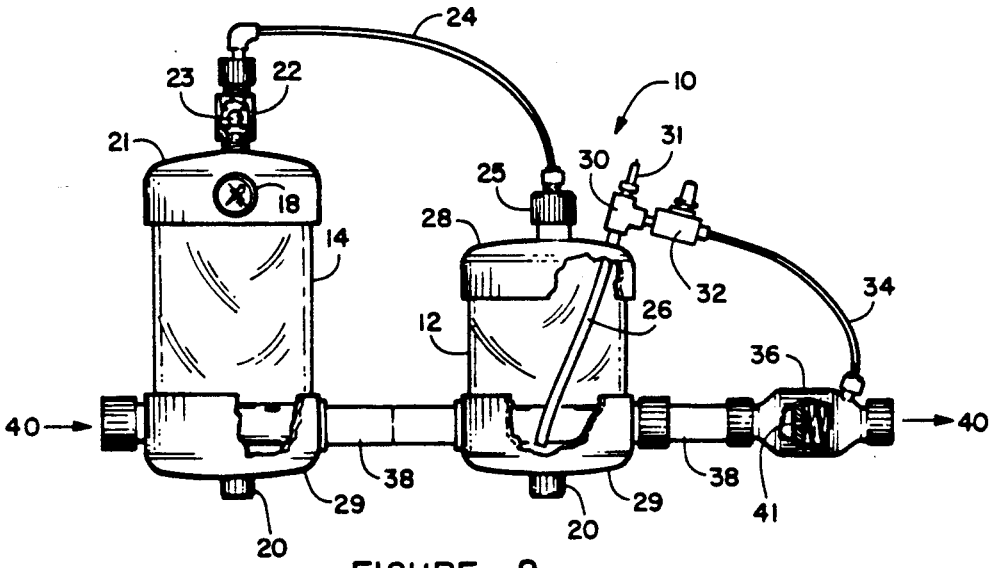
FIG. 2 is a side view showing of the embodiment of FIG. 1.

The automatic proportioning fertilizer injector 10 of the invention is shown in FIGS. 1 and 2. The embodiment of FIGS. 1 and 2 comprises a first and second tank 12 and 14 respectfully. Tank 12, the smaller of the two tanks is designed to hold a quality of a liquid fertilizer or the like for metering into an irrigation water line 16. The larger tank 14 initially is left empty and is used as a air compression pump. The tank 14 may include a pressure indicator gauge 18 for indicating the pressure build up in the tank. A drain outlet 20 is located in the bottom most position 27 of the tank 14. This drain outlet allows for residue or the like to be drained from the interior of the tank as desired. Centrally positioned on the top 21 of the tank 14 is a ball float type valve 22 with an internal float ball 23. The ball float valve 22 allows air to exit through the tube 24 interconnecting tank 14 with tank 12, but does not allow any liquid from tank 14 to pass therethrough. The purpose of the ball float valve will be hereinafter discussed in more detail. The tube 24 communicates with the top interior of tank 12. Tank 12 has a similar drain outlet 20. A tube 26 extends into the tank 12 from the upper surface or top 28 to a location just off of the bottom surface 29 thereof near the drain 20. The tube 26 has a sealed relationship with the upper or top surface of tank 12 that it extends through. At the upper end of the tube 26 is a T connection 30. One end of the T connection contains an air valve 31 which is normally open under static conditions of the injector 10 and in a closed position when the injector system is in operation. The other side of the T connection is attached to a metering valve 32 which is used to meter or control the flow of liquid from the tank 12. The metering valve 32 is infinitely variable between a fully closed condition to a fully open condition. A tube 34 extends from the valve 32 and is connected to the upstream side of a pressure check valve 36. The pressure check valve 36 allows water to flow through the conduit 38 in the direction of arrows 40 when the pressure of that flow exceeds about 2 pounds. A passageway 41 extends through the pressure check valve 36 and allows a slight fluid passage through the check valve when it is closed to normal flow therethrough.

The conduit 38 passes through both tank 12 and tank 14 as can be seen in the two drawing Figures. The conduit has a sealed relationship with the tanks at it entry and exit therethrough. A pair of openings 42 and 44 in the conduit 38 are provided within tank 14. Opening 42 is in the tank bottom side of the conduit and the opening 44 is in the tank top side of the conduit. The opening 42 is considerably larger in cross-section than the opening 44 the purpose of which will hereinafter explained.

A sight gauge 43 and an accompanying scale may be employed for monitoring the contents of the tank 12 if desired. It should be understood that the sight gage is helpful in knowing the amount of liquid fertilizer remaining in tank 12 as the tank is generally constructed with a non-transparent material such as white or black PVC plastic.

OPERATION OF THE FIRST PREFERRED EMBODIMENT

In operation the tank 12 is filled with a liquid solution of fertilizer or the like through screw cap 25 for mixing with the flow of water through conduit 38 to a garden or the like to be fertilized. When water is caused to flow through conduit 38 at a pressure between 20 and 60 pounds, the check valve 36 is caused to open allowing water to exit the end of the check valve. Water flowing in the conduit is caused to enter tank 14 through opening 42 and slowly fill the tank with liquid. Opening 44 allows a vent for the water to enter the opening 42 readily. The entry of water in tank causes the air in the tank to become compressed which elevates the ball 23 in the ball valve 22 sufficiently to allow the compressed air to enter the top of tank 12. The compressed air entering the top of tank 12 causes the liquid in the tank 12 to be forced upward in tube 26 closing air vent valve 31. The liquid flows through tube 34 in an amount determined by the setting of metering valve 32 and into conduit 38 for mixing with the water flowing therethrough. When the tank 14 fills with water the ball float of the float valve is elevated by the water level to seal off the opening from the valve to conduit 24 preventing water from entering the tank 12. The tanks 12 and 14 are purposely sized so that when tank 14 fills completely with water tank 12 is empty of liquid chemical. When all of the liquid is dispensed from the tank 12 and the supply of water is terminated, The passage 41 in the now closed check valve 36 and the now open air vent valve 31 allows the water in tank 14 to slowly drain through opening 42 into the conduit 40 and drain therefrom. After a refill of tank 12 the operation can be repeated. The amount of liquid from tank 12 entering the conduit can be finely adjusted by further adjustment of the metering valve 32.

SECOND PREFERRED EMBODIMENT OF THE INVENTION

Figure 3:
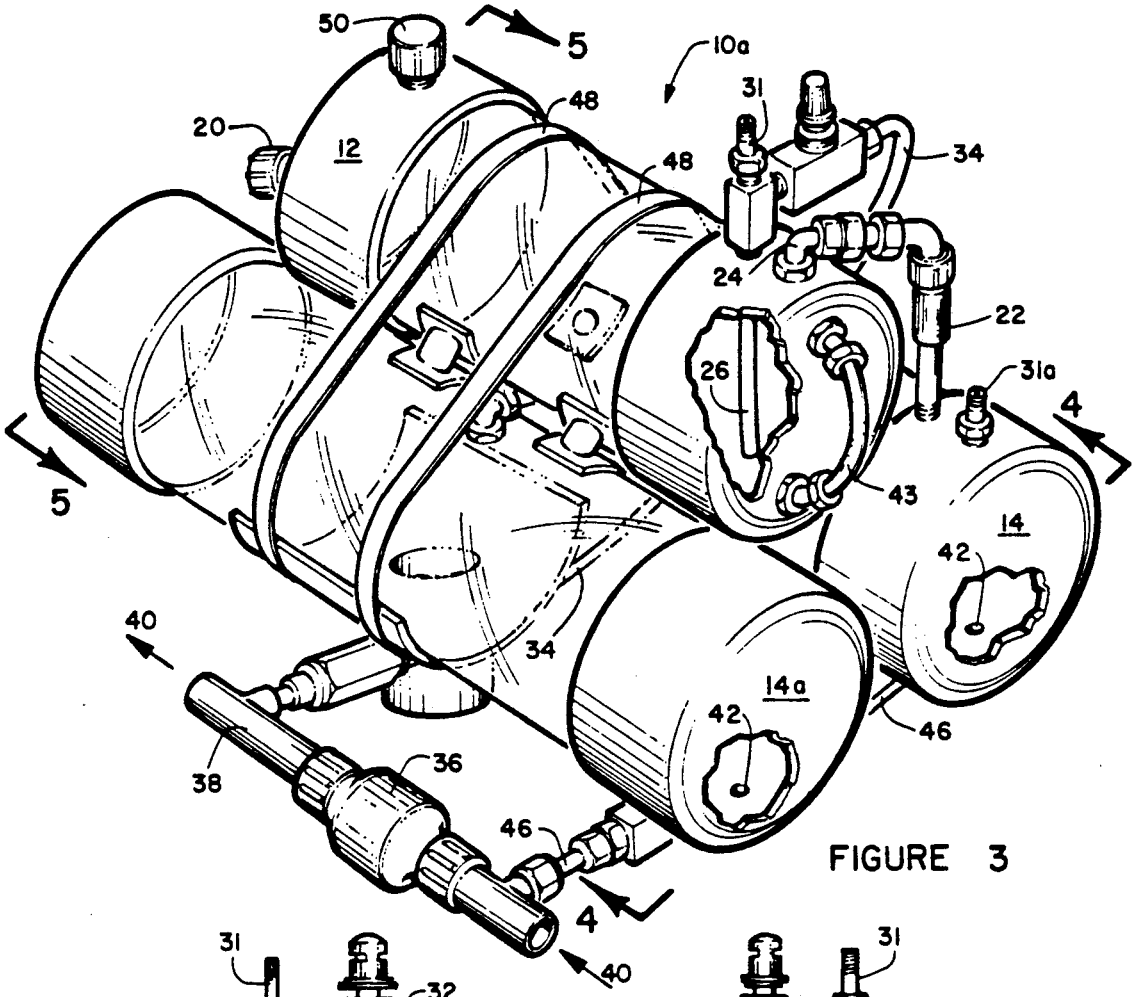
FIG. 3 is a perspective showing of a second embodiment of the invention.
Figure 4:
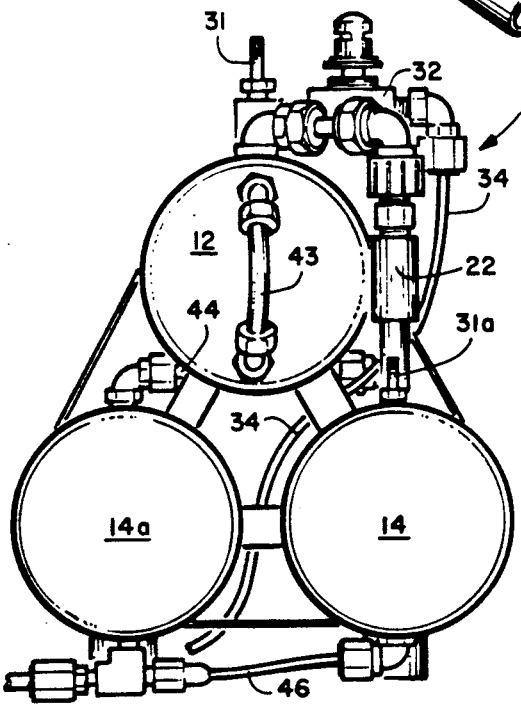
FIG. 4 is a view along line 4—4 of FIG. 3.
Figure 5:
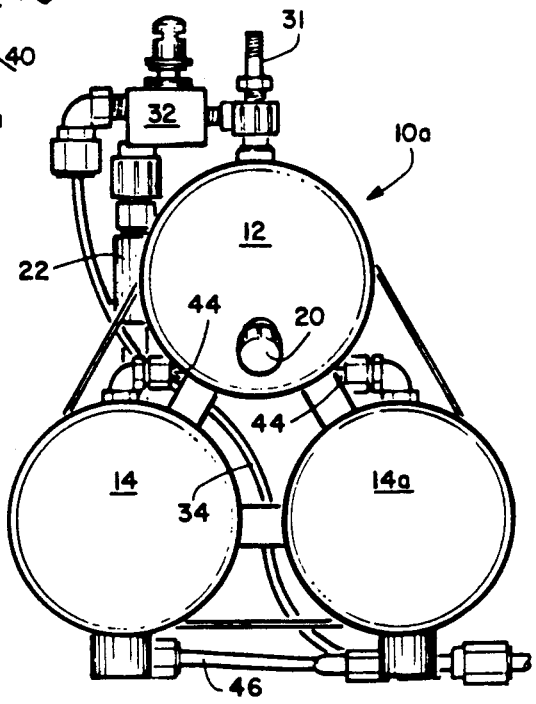
FIG. 5 is a view along line 5—5 of FIG. 3.

Referring now specifically to drawing FIGS. 3-5 which depict a second embodiment **10*a* of the invention. The second embodiment is very similar in construction and operation as the first embodiment hereinbefore discussed. The principle difference between the two embodiments is that in the second embodiment the tanks 12 and 14 are positioned on their sides rather than in an upright position, tank 12 has an increased capacity, an extra tank 14*a* connected to tank 14 via conduit 44 effectively increases the capacity of tank 14, the two tanks 14 and 14*a* are connected to the water supply line 38 by means of conduit 46 and an extra air vent valve is utilized on air tank 14 to expedite the draining of tanks 14 and 14*a*** at the end of a use operation.

The three tanks 12, 14 and **14*a* are strapped together by means of straps 48. The straps 48** can be made of any suitable material such as, for example, steel, cloth or the like suitable for the purpose intended.

OPERATION OF THE SECOND EMBODIMENT

The theory of operation of this second embodiment is the same as the first embodiment. Water under pressure entering conduit 38 opens check valve 36 and enters conduit 46 filling the two tanks 14 and 14*a* via openings 42, one in each tank. The water entering tanks 14 and 14*a* compress the air stored therein and pass through ball valve 22 and closes air vent 31*a*. This causes liquid from tank 12 to flow out conduit 26 closing air valve 31 and passing through the open setting of metering valve 32 into conduit 34 and to the water flow in conduit 38. When tank 12 is empty and tanks 14 and 14*a* are filled with water from conduit 38 and the water under pressure flowing through conduit 38 is terminated, the vent valves 31 and 31*a* open to the atmosphere and the water drains from tanks 14 and 14*a* through openings 42 into conduit 46, through passage way 41 of the check valve 36 and into the conduit 38. Like noted above, the operation can be repeated by removing cap 50 on tank 12 and refilling the tank with a desired liquid.

For ease of discussion, the system has been described as a system for mixing liquid fertilizer in an irrigation system. It should be understood that any liquid chemical or otherwise can be placed in the tank 12 for mixing with water under pressure flowing through conduit 38.

The material of construction may be inexpensive plastic, metal or the like suitable for practicing the invention. Stainless steel bay be employed for the mixing of corrosive chemicals or the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. An apparatus for the automatic controlled dispensing of a liquid substance into a first conduit of flowing water under pressure comprising:

a first tank having a top and a bottom communicating with said flowing water through at least one opening in said first conduit;

a second tank having a top and bottom;

a first valve means located on the top of said first tank, said first valve means allows pressurized air to flow into said second tank and prevents any liquid from flowing from said first tank to said second tank;

a second conduit means interconnecting said first valve means with the interior of said top of said second tank;

a third conduit means extending from a location adjacent to the inside bottom of said second tank to a position exterior of the top thereof;

a second valve means communicating with the downstream end of said third conduit, said second valve means being normally open to the atmosphere and closed to said atmosphere when the inside of said second tank is pressurized;

a third valve means having and input and an output, said input connected downstream of said second valve means;

a normally closed pressure activated valve positioned in series with said first conduit, said pressure actuated valve having a calibrated leak therethrough when closed; and a fourth conduit connected to said output of said third valve means and connected to said first conduit downstream of said pressure activated valve.

2. The invention as defined in claim 1 wherein said first tank has a greater volume than said first tank.

3. The invention as defined in claim 1 wherein said first tank comprises two separate tanks.

4. The invention as defined in claim 1 wherein said first tank includes a pressure gauge positioned at said top thereof.

5. The invention as defined in claim 1 wherein said first valve is a float valve which includes a ball float therein.

6. The inventions defined in claim 1 wherein at least said second tank includes a drain in one end thereof.

7. The invention as define in claim 1 wherein said first and second valve means when operated change states between open and closed.

8. The invention as defined in claim 1 wherein said third valve means is manually operable through an infinite number of positions between a fully closed and fully open.

9. The invention as defined in claim 1 wherein said pressure activated valve is positioned downstream from said first tank's bottom communication with said flowing water.

* * * * *